US005334572A

United States Patent [19]

Vanier et al.

[11] Patent Number: 5,334,572

[45] Date of Patent: Aug. 2, 1994

[54] INTERLAYER FOR SLIPPING LAYER IN DYE-DONOR ELEMENT USED IN THERMAL DYE TRANSFER

[75] Inventors: Noel R. Vanier, Fort Collins, Colo.; David P. Brust, Rochester, N.Y.

[73] Assignee: Eastman Kodak Company, Rochester, N.Y.

[21] Appl. No.: 140,373

[22] Filed: Oct. 21, 1993

[51] Int. Cl.[5] ..... B41M 5/035; B41M 5/38

[52] U.S. Cl. ..... 503/227; 428/195; 428/341; 428/488.4; 428/500; 428/508; 428/510; 428/532; 428/913; 428/914

[58] Field of Search ..... 8/471; 428/195, 341, 428/488.4, 500, 508, 510, 532, 913, 914; 503/227

[56] References Cited

U.S. PATENT DOCUMENTS 4,753,921 6/1988 Henzel ..... 503/227

*Primary Examiner*—B. Hamilton Hess

*Attorney, Agent, or Firm*—Harold E. Cole

[57] ABSTRACT

A dye-donor element for thermal dye transfer comprising a support having on one side thereof a dye layer and on the other side thereof, in order, a subbing layer comprising a polymer having an inorganic backbone which is an oxide of a Group IVa or IVb element and a slipping layer, and wherein an interlayer is located between the subbing layer and the slipping layer, the interlayer comprising a polymer having free hydroxyl groups.

20 Claims, No Drawings

INTERLAYER FOR SLIPPING LAYER IN DYE-DONOR ELEMENT USED IN THERMAL DYE TRANSFER

This invention relates to dye donor elements used in thermal dye transfer, and more particularly to the use of an interlayer located between a subbing layer and a slipping layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A slipping layer is usually provided on the backside of the dye-donor element to prevent sticking to the thermal head during printing. A subbing layer is also usually needed to promote adhesion between the support and the slipping layer.

U.S. Pat. No. 4,753,921 relates to a polymeric subbing layer for a slipping layer of a dye-donor element. The slipping layer binders disclosed may be a polymer having free hydroxyl groups. However, there is no disclosure in that patent that an interlayer comprising a polymer having free hydroxyl groups be used between the subbing layer and the slipping layer.

U.S. Pat. No. 4,753,921 discloses the use of a titanium alkoxide as a subbing layer between a polyester support and a slipping layer. While this material is a good subbing layer for adhesion, problems have arisen when certain lubricants are used in the slipping layer in that these lubricants may reduce the adhesion between the slipping layer binder and the titanium alkoxide subbing layer. It is an object of this invention to be able to use these lubricants in the slipping layer while maintaining good adhesion to a titanium alkoxide subbed support.

These and other objects are achieved in accordance with this invention which relates to a dye-donor element for thermal dye transfer comprising a support having on one side thereof a dye layer and on the other side thereof, in order, a subbing layer comprising a polymer having an inorganic backbone which is an oxide of a Group IVa or IVb element and a slipping layer, and wherein an interlayer is located between the subbing layer and the slipping layer, the interlayer comprising a polymer having free hydroxyl groups.

In a preferred embodiment of the invention, the Group IVa or Group IVb element is titanium, zirconium or silicon. In another preferred embodiment, the polymer is formed from an organic titanate or zirconate, such as tetrakis(2-ethylhexyl)titanate, bis(ethyl-3-oxobutanolato-$O^1O^3$)bis(2-propanolato)titanium, isopropyl triisostearoyl titanate or neopentyl(diallyloxy) tri(N-ethylenediamino)ethyl zirconate (Kenrich Petro Chemical, Bayonne, N.J.); or is formed from a titanium or zirconium alkoxide, such as titanium tetra-isopropoxide, titanium tetra-n-butoxide (commercially available as Tyzor TBT ® from DuPont) or zirconium n-propoxide.

The interlayer of a polymer having free hydroxyl groups may be, for example, a poly(vinyl butyral), a poly(vinyl acetal), a phenoxy resin, or a cellulose acetate propionate. It may be present in any amount which is effective for the intended purpose. In general, good results have been obtained when the interlayer polymer is present at a concentration of from about 0.0001 to about 1.0 g/m$^2$, preferably from about 0.01 to about 0.3 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumikaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumiacryl Blue 6G ® (Sumitomo Chemical Co., Ltd.), and Aizen Malachite Green ® (Hodogaya Chemical Co., Ltd.);

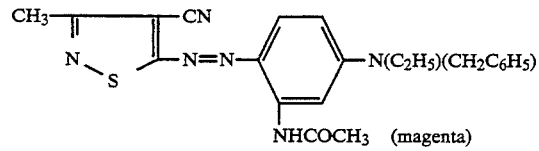

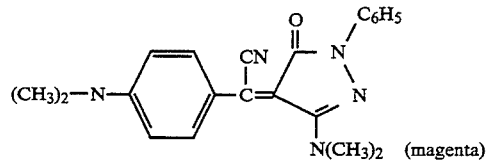

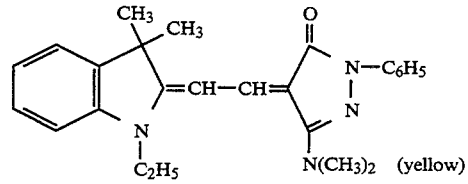

-continued

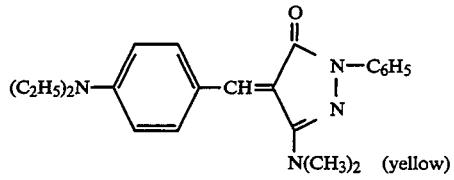

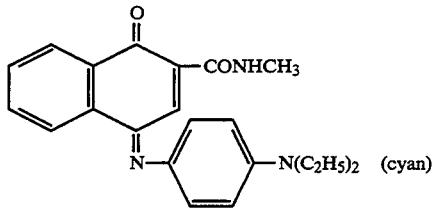

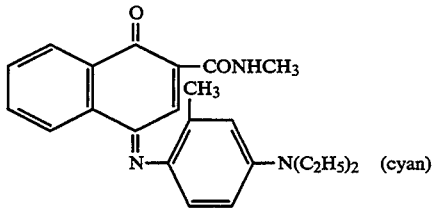

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any slipping layer may be used in the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U. S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 mm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Patent Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following example is provided to illustrate the invention.

EXAMPLE

A) A control dye-donor element was prepared by coating on a 6 μm poly(ethylene terephthalate) support:

1) a subbing layer of titanium alkoxide (DuPont Tyzor TBT) ® (0.12 g/m$^2$) from a n-propyl acetate and n-butyl alcohol solvent mixture, and 2) a dye layer containing the first cyan dye illustrated above (0.42 g/m$^2$) in a cellulose acetate propionate binder (CAP 482) (Eastman Chemicals Company) (2.5% acetyl, 45% propionyl) (0.66 g/m$^2$) coated from a toluene, methanol and cyclopentanone solvent mixture.

On the back side of the element were coated the following layers in sequence:

1) a subbing layer of titanium alkoxide (DuPont Tyzor TBT) ® (0.12 g/m$^2$) from n-butyl alcohol solvent, and
2) a slipping layer containing an aminopropyldimethyl-terminated polydimethylsiloxane, PS513 ® (Petrarch Systems, Inc.) (0.011 g/m$^2$), candellila wax (pre dissolved in toluene at 60° C.), (0.032 g/m$^2$), and p-toluenesulfonic acid (0.0003 g/m$^2$) in a cellulose acetate propionate binder (CAP 482) (Eastman Chemicals Company) (2.5% acetyl, 45% propionyl) (0.53 g/m$^2$) coated from a mixture of toluene, methanol and cyclopentanone.

Other control dye-donors were prepared similar to A) except that the binder was replaced with other binders as identified in Tables 1 and 2. In one of the control dye-donors, the candellila wax was replaced with Zonyl UR ®, a perfluorophosphate surfactant (DuPont Corp.) at 0.01 g/m$^2$.

Dye-donor elements according to the invention were prepared similar to A), except that they contained an interlayer coated between the subbing layer and the slipping layer using the materials identified in Tables 1 and 2. The interlayers were coated from a toluene/methanol/cyclopentanone solution except for the Lexan 141 ® polycarbonate (General Electric Co.), which was coated from tetrahydrofuran.

Adhesion of the slipping layer was tested by lightly scoring the donor, applying Scotch Magic Transparent Tape, #810, (3M Corp) and removing it (a) slowly, and the (b) rapidly, and checking for the percentage of the test tape covered by removed slipping layer material. The values for methods (a) and (b) were averaged and ratings assigned as shown below:

Poor (more than 60% of test tape surface covered by adhering material from slipping layer)
Fair (30–60% coverage)
Fair–Good (20–30% coverage)
Good (10–20% coverage)
Excellent (1–10% coverage)

The following results were obtained:

TABLE 1

| INTERLAYER (g/m$^2$) | SLIPPING LAYER BINDER | REMOVAL WITH TAPE |
|---|---|---|
| none (control) | CAP 482 | Poor |
| none (control) | Butvar ® 98 | Fair–good |
| none (control) | PVAcetal | Fair |
| CAP 482 (0.11) | CAP 482 | Excellent |
| CAP 482 (0.11) | Butvar ® 98 | Excellent |
| CAP 482 (0.11) | PVAcetal | Excellent |
| Butvar ® 98 (0.11) | Butvar ® 98 | Excellent |
| Butvar ® 98 (0.11) | CAP 482 | Excellent |
| PVAcetal (0.11) | PVAcetal | Good |

CAP 482 is cellulose acetate propionate (Eastman Chemicals Company)
Butvar ® 98 is a poly(vinyl butyral) resin (Monsanto Company)
PVAcetal is a poly(vinyl acetal) KS-1 (Sekisui Co.)

The above results indicate that the control elements without an interlayer but with a slipping layer binder containing free hydroxyl groups (CAP 482, Butvar ® and PVAcetal) had only fair or poor adhesion to the Tyzor ® subbing layer. However, these same elements with an interlayer of a polymer containing free hydroxyl groups (CAP 482, Butvar ® and PVAcetal) between the subbing layer and the slipping layer, had good or excellent adhesion.

TABLE 2

| INTERLAYER (g/m$^2$) | SLIPPING LAYER BINDER | REMOVAL WITH TAPE |
|---|---|---|
| none (control) | CAP 482 | Poor |
| none (control) | CAP 482 | Poor |
| none (control) | PMMA | Poor |
| CAP 482 (0.11) | CAP 482 | Excellent |
| CAP 482 (0.36) | CAP 482 | Excellent |
| CAP 482 (0.03) | CAP 482 | Excellent |
| CAP 482 (0.01) | CAP 482 | Excellent |
| CAP 482 (0.003) | CAP 482 | Fair–Good |
| CAP 482 (0.11) | CAP 482 | Fair–Good |
| CAP 482 (0.11) | PMMA | Excellent |
| PKHJ (0.11) | CAP 482 | Good |
| PMMA (0.11) (control) | CAP 482 | Poor |
| Lexane ® 141 (0.11) (control) | CAP 482 | Poor |

*Slipping layer contained Zonyl UR ® perfluorophosphate surfactant (DuPont Company) instead of candellila wax
PMMA is poly(methyl methacrylate) (Scientific Polymer Products, Inc.)
CAP 482 is cellulose acetate propionate (Easrman Chemicals Company)
PKHJ is a phenoxy resin UCAR ® PKHJ (Union Carbide Company)
Lexan ® 141 is a biphenol-A polycarbonate resin (General Electric Company)
Butvar ® 98 is a poly(vinyl butyral)resin (Monsanto Company)
PVAcetal is a poly(vinyl acetal) KS-1 (Sekisui Co.)

The above results show that the control elements without an interlayer but with different lubricants (Zonyl UR ® instead of candellila wax) and with a different binder (PMMA) again had poor adhesion to the Tyzor ® subbing layer. However, these same elements with an interlayer of a polymer containing free hydroxyl groups (CAP 482) between the subbing layer and the slipping layer, had much improved adhesion.

The data also show that CAP 482 was effective as an interlayer at amounts from 0.003–0.36 g/m$^2$.

The phenolic resin PKHJ, which contains free hydroxyl groups, was also effective as an interlayer for increasing adhesion. However, PMMA and Lexan ®

141, which do not contain free hydroxyl groups, were not effective in promoting adhesion.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side thereof, in order, a subbing layer comprising a polymer having an inorganic backbone which is an oxide of a Group IVa or IVb element and a slipping layer, and wherein an interlayer is located between said subbing layer and said slipping layer, said interlayer comprising a polymer having free hydroxyl groups.

2. The element of claim 1 wherein said Group IVa or IVb element is titanium, zirconium or silicon.

3. The element of claim 1 wherein said subbing layer polymer is formed from an organic titanate or zirconate.

4. The element of claim 1 wherein said subbing layer polymer is formed from a titanium or zirconium alkoxide.

5. The element of claim 1 wherein said subbing layer polymer is formed from a titanium tetra-n-butoxide.

6. The element of claim 1 wherein said interlayer polymer is a poly(vinyl butyral), a poly(vinyl acetal), a phenoxy resin, or a cellulose acetate propionate.

7. The element of claim 1 wherein said interlayer polymer is present at a concentration of from about 0.0001 to about 1.0 g/m$^2$.

8. A process of forming a dye transfer image comprising:

(a) imagewise-heating a dye-donor element comprising a support having on one side thereof a dye layer and on the other side thereof, in order, a subbing layer comprising a polymer having an inorganic backbone which is an oxide of a Group IVa or IVb element, and a slipping layer, and (b) transferring a dye image to a dye receiving element to form said dye transfer image, wherein an interlayer is located between said subbing layer and said slipping layer, said interlayer comprising a polymer having free hydroxyl groups.

9. The process of claim 8 wherein said Group IVa or IVb element is titanium, zirconium or silicon.

10. The process of claim 8 wherein said subbing layer polymer is formed from an organic titanate or zirconate.

11. The process of claim 8 wherein said subbing layer polymer is formed from a titanium or zirconium alkoxide.

12. The process of claim 8 wherein said subbing layer polymer is formed from a titanium tetra-n-butoxide.

13. The process of claim 8 wherein said interlayer polymer is a poly(vinyl butyral), a poly(vinyl acetal), a phenoxy resin, or a cellulose acetate propionate.

14. The process of claim 8 wherein said interlayer polymer is present at a concentration of from about 0.0001 to about 1.0 g/m$^2$.

15. A thermal dye transfer assemblage comprising (a) a dye-donor element comprising a support having on one side thereof a dye layer and on the other side thereof, in order, a subbing layer comprising a polymer having an inorganic backbone which is an oxide of a Group IVa or IVb element and a slipping layer, and (b) a dye receiving element comprising a support having thereon a dye image-receiving layer, said dye-receiving element being in a superposed relationship with said dye-donor element so that said dye layer is in contact with said dye image-receiving layer, wherein an interlayer is located between said subbing layer and said slipping layer, said interlayer comprising a polymer having free hydroxyl groups.

16. The assemblage of claim 15 wherein said Group IVa or IVb element is titanium, zirconium or silicon.

17. The assemblage of claim 15 wherein said subbing layer polymer is formed from an organic titanate or zirconate.

18. The assemblage of claim 15 wherein said subbing layer polymer is formed from a titanium tetra-n-butoxide.

19. The assemblage of claim 15 wherein said interlayer polymer is a poly(vinyl butyral), a poly(vinyl acetal), a phenoxy resin, or a cellulose acetate propionate.

20. The assemblage of claim 15 wherein said interlayer polymer is present at a concentration of from about 0.0001 to about 1.0 g/m$^2$.

* * * * *